US006399157B1

(12) United States Patent
Zaretsky

(10) Patent No.: US 6,399,157 B1
(45) **Date of Patent: *Jun. 4, 2002**

(54) METHOD AND APPARATUS FOR CONTROLLABLE ELECTRICAL CHARGING OF A WEB SUPPORT

(75) Inventor: Mark C. Zaretsky, Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/562,703

(22) Filed: Apr. 28, 2000

(51) Int. Cl.[7] ..... B05D 3/14; B05C 11/00

(52) U.S. Cl. ..... 427/444; 427/8; 427/450; 427/470; 427/402; 427/420; 118/621; 118/324; 118/410; 118/411; 118/DIG. 4

(58) Field of Search ..... 427/8, 458, 470, 427/402, 420, 444; 118/621, 410, 411, DIG. 4, 324

(56) References Cited

U.S. PATENT DOCUMENTS

| | | | | |
|---|---|---|---|---|
| 4,172,001 A | * | 10/1979 | Heetderks | 156/157 |
| 4,340,621 A | | 7/1982 | Matsumiya et al. | |
| 5,154,951 A | | 10/1992 | Finnicum et al. | 427/402 |
| 5,340,616 A | | 8/1994 | Amano et al. | 427/458 |
| 5,358,737 A | | 10/1994 | Mues et al. | |
| 5,683,750 A | | 11/1997 | Hoff et al. | |
| 5,700,524 A | | 12/1997 | Hoff et al. | |
| 5,755,881 A | | 5/1998 | Fenoglio et al. | |

FOREIGN PATENT DOCUMENTS

| | | | |
|---|---|---|---|
| EP | 0 300 098 A1 | | 7/1987 |
| EP | 390 774 B1 | * | 7/1992 |
| JP | 1-258772 | * | 10/1989 |

* cited by examiner

*Primary Examiner*—Katherine A. Bareford
(74) *Attorney, Agent, or Firm*—Mark G. Bocchetti

(57) ABSTRACT

Apparatus and method for depositing controlled short intervals of electrostatic charge on a moving web substrate to be coated, including a mathematical model that estimates the charging performance of the apparatus. The model is constructed via benchtop characterization of the apparatus. The model is implemented in coating production via an algorithm comprising a best-fit equation representing the model predictions over a range of relevant input parameter values such as web speed, web capacitance, and desired web voltage. The apparatus includes an electrical charging apparatus, a power supply for powering the charging apparatus, and a controller programmed with the algorithm for automatically setting and controlling the intensity and duration of the output of the power supply to yield the optimal electrostatic potential on the charging apparatus. In operation, run-specific variables including web type and coating speed are also provided as inputs to the controller. The invention is useful in minimizing coating disturbances at starts and between-roll splices.

12 Claims, 3 Drawing Sheets

METHOD AND APPARATUS FOR CONTROLLABLE ELECTRICAL CHARGING OF A WEB SUPPORT

FIELD OF THE INVENTION

The invention relates to methods and apparatus for electrically charging a substrate prior to coating a liquid composition to the substrate surface to form a coated layer thereupon; and more particularly, to methods and apparatus for controllably charging a moving web substrate prior to starting the application of an aqueous composition to the substrate surface; and most particularly, to methods and apparatus for providing a controlled high level of electrostatic charge to a web substrate for a brief time during initiation of application of a photographic composition and/or at splices between consecutive rolls of web substrate during a multiple-roll coating.

BACKGROUND OF THE INVENTION

In coating a liquid composition to a moving web substrate, a critically important event is the first contact of the composition being delivered to the substrate surface at the start of coating, and the subsequent immediate formation of a stable coating relationship between the composition and the moving substrate surface. This event is especially complicated for multiple-layer bead coating from a multiple-slot slide hopper, as is well known in the art. Prior to commencement of coating, the multiple-layer composition is flowing down the hopper slide surface and over the hopper lip to a drain. Thus, the coating pack as presented to the web surface is inverted when the hopper is moved into coating position, the composition topcoat or overcoat being the first liquid to strike the web. The overcoat typically is not optimally coatable as the contact layer and may not readily wet the web surface. Further, the entire coating pack must re-invert virtually instantaneously into normal layer sequence as the composition begins to follow the web surface away from the lip. Further, the thick composition at the lip which typically is flowing downwards under gravity at a rate of a few feet per minute is instantaneously stretched and accelerated to web speed, which may be 1000 or more feet per minute. Further, the aerodynamic relationship of the hopper to the web changes as the bead is formed, the former coating gap is sealed, and a vacuum is formed under the lip. The superposition of these sub-events can result in a starting area of coating on the web which may be uneven, which may be many times thicker than at coating equilibrium, and which may feature stable widthwise thickness non-uniformities manifested as running streaks in the coating. Such streaks can render the entire coating defective. The thicker areas may not fully dry in the coating machine dryer before encountering face-side rollers to which the tacky composition may undesirably adhere and track off. At best, such a confused area of coating is discarded at finishing and thus represents coated waste.

Various approaches are known in the art to minimize the length of coating which must be discarded, either by minimizing thick coating starts, or by removing thick areas of coated composition from the web.

U.S. Pat. No. 4,340,621 to Matsumiya et al. discloses the use of a thin coating of a pretreatment liquid to the area of the web on which the coating start is to be made to improve wetting by the overcoat, combined with an increase in the under-lip vacuum level at the moment of composition contact with the web.

U.S. Pat. No. 5,154,951 to Finnicum et al. discloses a method and apparatus for immediate response and precise control of under-lip vacuum level to instantaneously and temporarily increase the level of under-lip vacuum.

U.S. Pat. No. 5,358,737 to Mues et al. discloses a method and apparatus for removal of non-dried thick areas of coating by brushing off the still-wet composition with a rotary brush prior to winding of the coated web.

U.S. Pat. No. 5,683,750 to Hoff et al. discloses the use of a low-viscosity temporary extra topcoat to increase wettability of the upper surface of the composition pack.

U.S. Pat. No. 5,700,524 to Hoff et al. teaches a shear-thinning topcoat to improve initial coatability.

U.S. Pat. No. 5,755,881 to Fenoglio et al. discloses method and apparatus for vacuum removal of excess composition from the web after a coating start while the composition is still liquid.

Another event of critical importance in multiple-roll coatings is coating across splices between rolls. Rolls are typically butt-spliced by a length of plastic adhesive tape which itself forms a ridge transverse to the coating bead. In addition, the joint between the webs can tend to fold as a hinge as it passes around the coating backing roller. Both of these effects can cause substantial disturbance of the coating bead, known in the art as "splice blow-up." Studies have shown that a high percentage of running streaks result from bubbles generated by the splice disturbance and then dynamically trapped in the coating composition at the hopper lip.

An approach known in the art for reducing the severity of heavy starts and splice blow-up is to electrify the surface of the web to a high electrostatic voltage level in the start or splice area of the web onto which the composition is to be coated, just ahead of the coating station. See, for example, the relevant disclosures of U.S. Pat. No. 5,340,616 to Amano et al. and European Pat. No. 0 300 098 A1. Typically, an electrical charging apparatus having an array of exposed electrodes is disposed transverse to the direction of travel of the web. The charging apparatus, described more filly below, may or may not be in contact with the web surface. Charging of the web makes the web surface apparently more highly wettable and can provide highly even, relatively undisturbed coating starts and splices. A drawback of charging webs for photographic coating is that charging can fog the emulsion; therefore, electrification may be conducted solely to facilitate the start of coating or the coating of splices, and web areas so treated must be removed as waste at finishing.

Since the electrostatically treated and coated area must be discarded, it is desirable to minimize the length of treated web, typically to only a few feet. At high coating speeds, therefore, the charging apparatus must be energized for only a fraction of a second. However, the power supply for the apparatus cannot be set at a fixed power level which is optimal for all types of webs to be coated by a given coating apparatus. Webs differing in polymer composition, thickness, surface pretreatment, subbing layers, and coating speed can require substantially different power levels to achieve optimal charging. In principle, a feedback control system might be employed wherein a non-contacting voltmeter downstream of the discharge apparatus monitors the web face side charge and provides a feedback signal to a power supply driving the apparatus. However, the distance between the apparatus and the voltmeter represents a time lag in the system and thus an irreducible minimum length of uncontrollably electrified web. Clearly, a feedback system is not feasible when the length of web to be electrified is of the same order as the distance between the power supply and the voltmeter.

In actual prior art practice, the settings for the power supply are made manually by an operator and are only experiential starting points which generally require modification during the course of a coating run. Settings may be varied manually by an operator based on visual inspection of prior samples in a run, rather than on an understanding and implementation of the fundamental relationship of the charging apparatus, the web to be charged, the web voltage level required, and the coating speed, which will lead to optimal charging of each web type.

The prior art fails to teach a system for automatically setting and controlling the output of the power supply of a charging apparatus to the optimal level for the proper length of time for any web being coated at any coating speed, based upon predetermined web, apparatus, and coating parameters.

SUMMARY OF THE INVENTION

It is therefore an object of the present invention to provide an improved programmably controlled web charging system for automatically providing an optimal level of electrostatic charge to web substrates at the start of coating and at splices to minimize heavy coating starts and splice blow-up.

It is a further object of the present invention to provide an improved web charging system including a programmable controller for controlling the output of a power generator.

It is a still further object of the present invention to provide an improved web charging system wherein a programmable controller utilizes an algorithm which models the charging system and is responsive to operational parametric input.

Yet another object of the present invention is to provide an improved programmably controlled web charging system for automatically providing an optimal level of electrostatic charge to web substrates which can be used in conjunction with a variety of different coating processes including, but not limited to, bead coating, curtain coating and extrusion hopper coating.

Briefly stated, the foregoing and numerous other features, objects and advantages of the present invention will become readily apparent upon a review of the detailed description, claims and drawings set forth herein. These features, objects and advantages are accomplished by using a charging apparatus for depositing controlled bursts of electrostatic charge on a moving web to be coated. Control of the deposition of electrostatic charge is performed using a mathematical model that estimates the charging performance of the charging apparatus. The model is constructed via benchtop characterization of the apparatus and of the webs to be coated. The model is implemented in coating production via either an algorithm comprising a best-fit equation or a lookup table, representing the model predictions over a range of relevant input parameter values such as web speed, web capacitance, and desired web voltage.

The apparatus includes a web charger, a power supply for powering the charger, and a controller programmed with the algorithm for automatically setting and controlling the intensity and duration of the output of the power supply. The web charger includes electrode arrangements, such as an array of electrodes, capable of creating sufficiently high electric fields when raised to high voltage so as to exceed the breakdown limit of air. This results in creation of positive and negative electrical charges that are then available for deposition onto the moving web substrate. Such arrangements may include wires, pins, brushes, and blades. Typically, these are non-contacting of the web to prevent mechanically damaging the web surface. Arrangements may also include a charged roller or rollers in contact with the web and which can create high electric fields at the entering or leaving nip.

In operation, run-specific variables including web type, coating speed, desired voltage level on the web, activation signal, and length of charging period are provided as inputs to the controller.

The term "web substrate" or "web" as used herein comprises a flexible, planar sheet formed of plastic polymer, paper, or metal. Such web substrates are typically the supporting element in photographic films, papers, and photoengraving products. Webs are generally of a predetermined width and may be variable or indefinite in length. They may be non-coated when subjected to the treatments described herein, or they may include one or more previously coated layers.

DETAILED DESCRIPTION OF THE INVENTION

Figure 1:
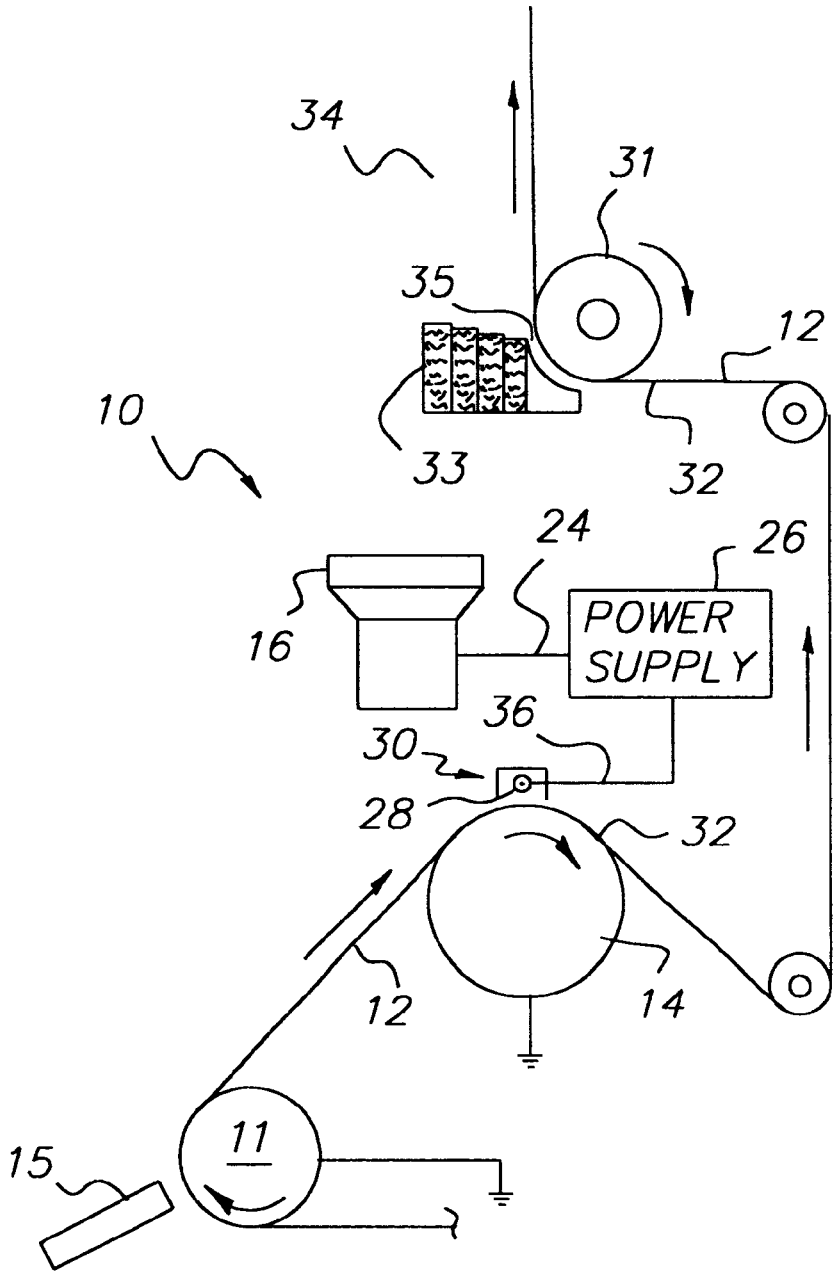
FIG. 1 is a schematic diagram of a coating system employing a controllable web charging system in accordance with the invention.

Turning first to FIG. 1, there is shown a controllable electrical charging system 10 for applying a residual high voltage to a web substrate 12 being conveyed around and in contact with a grounded roller 14. The system includes a programmable logic controller or computer 16 programmed with logic and responsive to sequence inputs for turning the system on and off and to run-specific operational inputs as will be described hereinafter. Controller 16 provides an output signal 24 directing a variable high voltage power supply 26 to emit a desired voltage. Power supply 26 is electrically connected to one or more electrodes 28 in a charge deposition apparatus such as an ionizer 30 adjacent to the web surface 32 to be coated with liquid composition at a coating application station 34 comprising a backing roller 31 and a coating applicator 33 having a lip 35. Ionizer 30 is operated at a voltage equal to the output voltage $V_{electrode}$ of the power supply. Prior to grounded roller 14, the web substrate 12 is conveyed around grounded roller 11 where an electrostatic charge sensor 15 such as a non-contacting electrostatic voltmeter is preferably used to monitor the incoming web voltage $V_{in}$ on web surface 32.

Controllable electrical charging system 10 is especially useful in assisting the coating of a liquid composition at coating starts, and when coating over splices between consecutive rolls of moving web. The controllable electrical charging system 10 of the present invention has the capability to automatically begin electrification at a desired lengthwise location along the web 12 at a controlled voltage level predetermined to be optimal for any given combination of web and operational parameters. The controllable electrical charging system 10 of the present invention further has the ability to controllably maintain that voltage level for a relatively short period of time, and the ability to cease electrification at the end of that time period.

Control logic is derived partly from off-line characterization of the ionizer 30 to determine two characteristic parameters, the cut-off voltage $V_{cut}$ and the ionizer impedance-area Z*A as a function of a range of imposed voltages 36 for a given ionizer configuration:

$$V_{cut}=f_1(V_{electrode}) \quad (1)$$

$$Z^*A=f_2(V_{electrode}) \quad (2)$$

In that most web substrates 12 may be considered capacitors that store charge deposited on them while passing beneath an ionizer, the voltage buildup associated with this charge deposition process can readily be modeled using the exponential relationship:

$$V_{web}=(V_{in}-V_{cut})e^{-t/\tau}+V_{cut} \quad (3)$$

where $V_{in}$ is the charge on the web prior to the ionizer 30, t is the time under the ionizer 30 (function of web speed), and $\tau$ is the time constant given by the ionizer impedance area and the web capacitance per unit area of web:

$$t=l/U \quad (4)$$

$$\tau=(Z^*A)(C/A) \quad (5)$$

where l is the ionizer width in the lengthwise direction of the web and U is the web speed. Also, the web capacitance per unit area is given by the ratio of the web permittivity $\epsilon$ to the web thickness d:

$$(C/A)=\epsilon/d \quad (6)$$

Therefore, the resulting $V_{web}$ can be computed over a range of electrode voltages $V_{electrode}$, web conveyance speeds U, web capacitances C/A, and incoming web voltages $V_{in}$ using Equations 1 through 6.

To actively control the ionizer 30 to achieve the desired $V_{web}$, these programming determinations may be entered into the controller in either of two ways. In a first method, a large, multi-dimensional data table is constructed and entered, and the controller draws values from the table based on the operational inputs of web speed, web type, and desired voltage $V_{web}$. A second, preferred method is to create an empirical model in the form of an algorithm comprising a polynomial equation containing all the relevant parameters, and to instruct the controller 16 to solve the equation, based upon these operational inputs, to set and control the power supply 26 via signal 24 to generate the proper output $V_{electrode}$ to yield the desired residual voltage $V_{web}$ on the web substrate 12. The polynomial equation takes the form of:

$$V_{electrode}=a_0+a_1U(C/A)+a_2V_{in}+a_3V_{web}+a_4U(C/A)V_{in}+a_5U(C/A)V_{web}+a_6V_{in}V_{web}+a_7[U(C/A)]^2+a_8V_{in}^2+a_9V_{web}^2 \quad (7)$$

where $a_0$ through $a_9$ are empirical proportionality constants.

Electrodes 28 in accordance with the present invention may take any of various well-known forms, either in contact with or non-contacting of the web surface, for example, wires, pins, brushes, blades, rollers, and combinations thereof.

Figure 2:
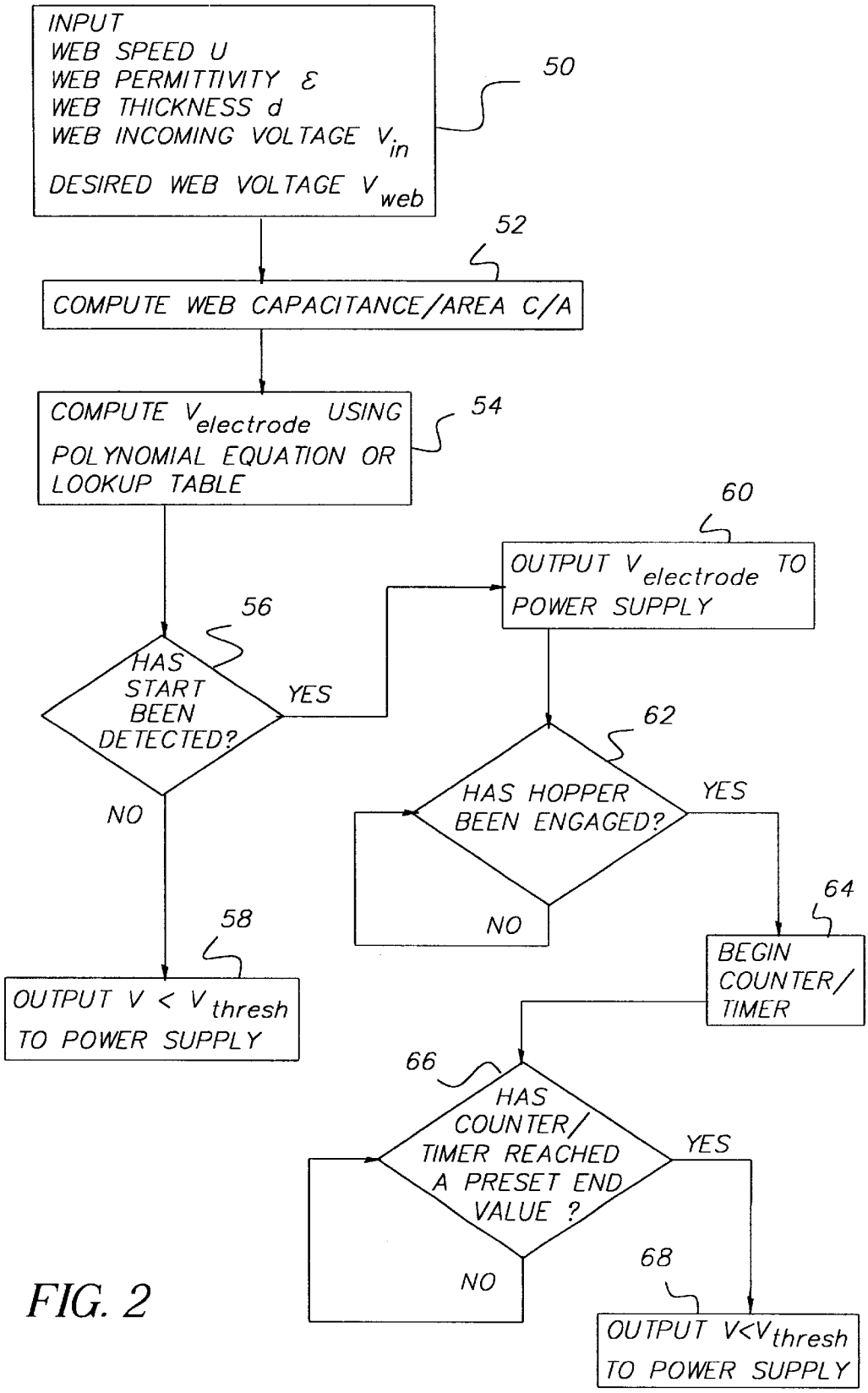
FIG. 2 is a flowchart describing the method as implemented in a programmable control unit for a coating start.

Looking next at FIG. 2 there is shown a logic diagram of the software controlling the operation of the present invention for coating start situations. As set forth in function box 50, preferably all of the parameters of web speed (U), web permittivity ($\epsilon$), web thickness (d), web incoming voltage ($V_{in}$), and desired web voltage ($V_{web}$) are input into the memory of the programmable logic controller 16. In some instances the present invention may be effectively practiced with the omission of the web incoming voltage ($V_{in}$) parameter. This would be an option, for example, when the charge on the incoming web is controlled, or when the amount of charge on the incoming web is not large enough to necessitate consideration. With that input the programmable logic controller 16 calculates the web capacitance/area (C/A) as noted in function box 52. The programmable logic controller 16 then computes $V_{electrode}$ using equation (7), or alternatively, through the use of a look-up table as indicated by function box 54. Per decision block 56, the programmable logic controller 16 determines whether or not it has received a startup signal. In a startup situation, a splice sensor (not shown) preferably still looks for a splice but the splice is between a leader and the web 12. When the splice is sensed a signal is sent to the programmable logic controller 16 that a startup has occurred. If a splice has not been detected then per function box 58 the output voltage of the power supply 26 is maintained below a threshold level $V_{thresh}$ at which no charge is generated. If a startup has been detected then the programmable logic controller 16 controls the power supply 26 such that an output voltage $V_{electrode}$ from the power supply 26 is generated per function box 60. This voltage change may be accomplished as a step change, a linear ramp, or a non-linear transition. Per decision block 62, the programmable logic controller 16 determines whether or not the coating application station 34 has been engaged so as to apply a coating onto web surface 32. If the coating application station 34 has not been engaged then the programmable logic controller 16 continues to check for this condition as designated in decision block 62 while continuing to operate power supply 26 at $V_{electrode}$. If the coating application station 34 has been engaged then a counter or timer is initiated as indicated in function block 64. Per decision block 66, the programmable logic controller 16 determines whether the counter or timer has reached a preset end value. If this end value has not been reached then the programmable logic controller 16 continues to check for this condition while continuing to operate power supply 26 at $V_{electrode}$. If the counter or timer has reached the preset end value then, per function block 68, the output voltage of the power supply 26 is reduced from $V_{electrode}$ to a voltage below $V_{thresh}$ at which no charge is generated. This reduction may be accomplished as a step change, a linear ramp, or a non-linear transition.

Figure 3:
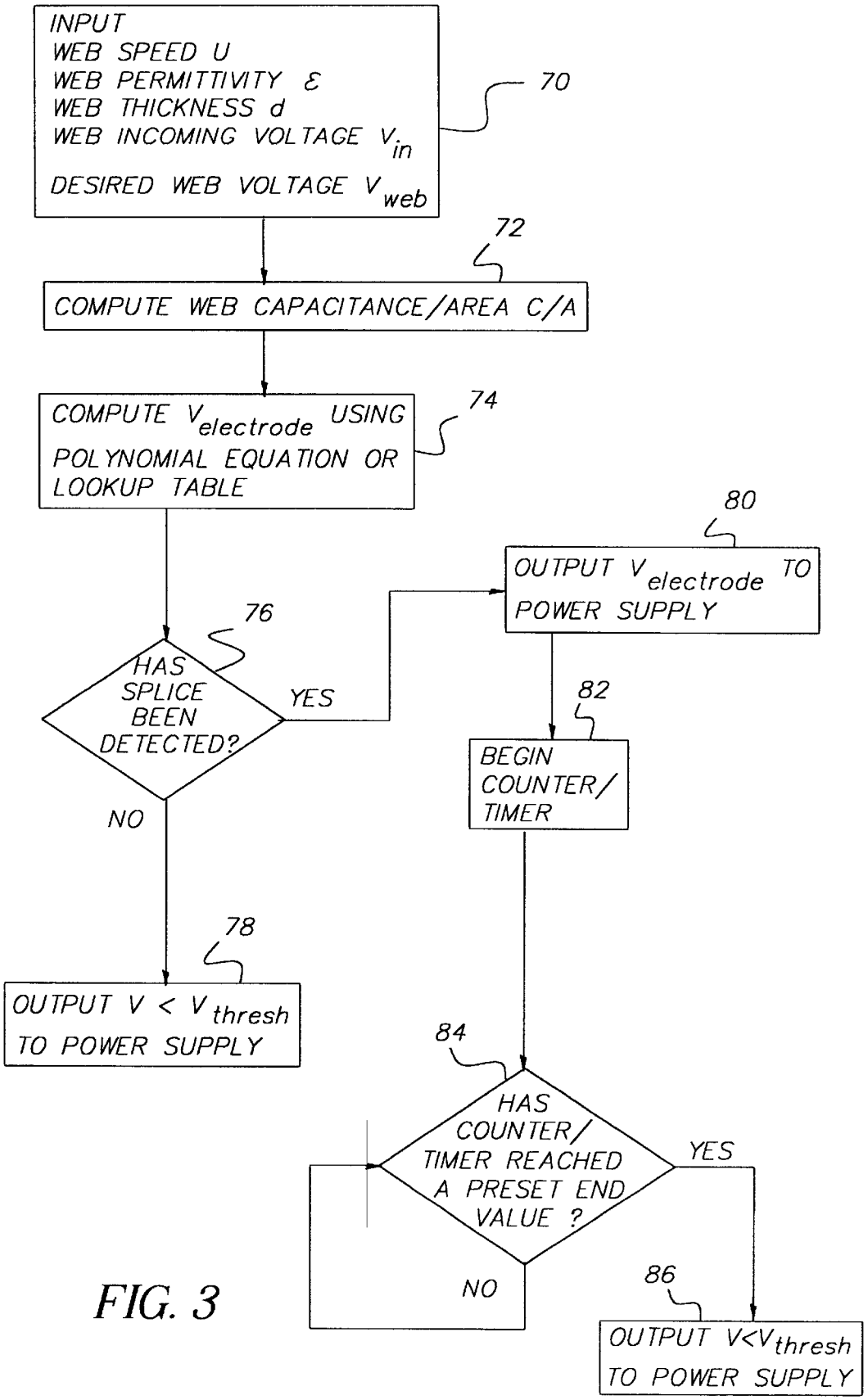
FIG. 3 is a flowchart describing the method as implemented in a programmable control unit for a coating splice.

Looking next at FIG. 3 there is shown a logic diagram of the software controlling the operation ofthe present invention for coating splice situations. As set forth in function box 70, the parameters of web speed (U), web permittivity ($\epsilon$), web thickness (d), web incoming voltage ($V_{in}$), and desired web voltage ($V_{web}$) are input into the memory of the programmable logic controller 16. With that input the programmable logic controller 16 calculates the web capacitance/area (C/A) per function box 72. The programmable logic controller 16 then computes $V_{electrode}$ using equation (7), or alternatively, through the use of a look-up table as indicated by function box 74. Per decision block 76, the programmable logic controller 16 determines whether or not a splice has been sensed. If a splice has not been detected then per function box 78 the output voltage of the power supply 26 is maintained below a threshold level $V_{thresh}$ at which no charge is generated. If a splice has been detected then the programmable logic controller 16 controls the power supply 26 such that an output voltage $V_{electrode}$ from the power supply 26 is generated per function box 80. This voltage change may be accomplished as a step change, a linear ramp, or a non-linear transition. A counter or timer governing the duration of the voltage application is then initiated, as noted by function box 82. Per decision block 84, the programmable logic controller 16 determines whether the counter or timer has reached a preset end value. If this end value has not been reached then the programmable logic controller 16 continues to check for this condition while continuing to operate power supply 26 at $V_{electrode}$. If the counter or timer has reached the preset end value then, per function block 86, the output voltage of the power supply 26 is reduced from $V_{electrode}$ to a voltage below $V_{thresh}$ at which no charge is generated. This reduction may be accomplished as a step change, a linear ramp, or a non-linear transition.

In operation, the coating station 34 receives a signal from a web conveyance event, such as the passage of a splice past a splice sensor (not shown). For the purposes of this invention, this web conveyance event may be characterized as an event requiring electrostatic charge deposition. The signal starts a timer (not shown) such that the position of the splice in the overall coating machine 34 is known at any given moment. The splice may be a splice from a leader roll to a roll of web substrate, as for the beginning of coating, or the splice may be between consecutive rolls of web substrate within a coating run. For a coating start, after the splice from the leader roll to the roll of the web substrate 12 to be coated, the "on" signal is given to the programmable logic controller 16 to calculate the required output from the power supply 26 and to instruct the power supply 26 to provide that output. The distance along the web path from the ionizer 30 to the coating station 34 is known, as is the speed of the web 12, so coating initiation is timed to occur just after the beginning of the electrified portion of the web 12 reaches the coating station 34. The programmable logic controller 16 is instructed to turn off the power supply 26 after the passage of a predetermined length of web 12, preferably only a few feet. Thus at high web speeds U, the ionizer may be energized for only a fraction of a second. The start of coating also may be accompanied by a temporary increase in under-lip vacuum (reduction in sub-atmospheric pressure) at the coating applicator, in known fashion.

Electrification of a web across in-run splices is similar, except that the power supply 26 is energized ahead of the splice and is turned off after the splice such that the trailing end of the lead roll and the head end of the succeeding roll are both electrified along with the actual splice material.

Although the coating station 34 depicted in FIG. 1 is a bead coating apparatus, those skilled in the art will recognize that the method and apparatus of the present invention can be used in conjunction with other coating apparatus such as, for example, to curtain coating apparatus, and extrusion hopper coating apparatus.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

Parts List

10 controllable electric charging system
11 grounded conveyance roller
12 web substrate
14 grounded conveyance roller
15 electrostatic charge sensor
16 programmable logic controller
24 output signal from 16
26 power supply
28 electrode
30 ionizer
31 backing roller
32 surface of web to be treated
33 applicator
34 coating application station
35 applicator lip
36 output voltage of 30

What is claimed is:

1. A method for charging a length of moving web to a voltage level to provide a coating assist with a charging device prior to coating a liquid composition onto a surface of the web with a curtain coating apparatus, an extrusion coating apparatus, or a bead coating apparatus, the method comprising the steps of:

(a) inputting at least one of a plurality of parameters selected from web speed (U), web permittivity ($\epsilon$), web thickness (d), web incoming voltage ($V_{in}$), and a desired web voltage ($V_{web}$) into a programmable controller;

(b) calculating web capacitance per unit area;

(c) determining using the programmable logic controller an output voltage for the charging device based on the web capacitance per unit area and the at least one of the parameters of web speed (U), web capacitance per unit area, and web incoming voltage ($V_{in}$) input in step (a) to achieve the desired web voltage;

(d) detecting an event in the moving web requiring electrostatic charge deposition, the event being a start-up or a splice;

(e) controlling a power supply to deliver the output voltage to the charging device; and (f) depositing an electrostatic charge onto the moving web with the charging device operating at the output voltage for a predetermined time period or for a predetermined length of the web to achieve the desired web voltage ($V_{web}$) after detecting the event requiring electrostatic charge deposition, and stopping the depositing of the electrostatic charge after the predetermined time period or the predetermined length of the web required by the event.

2. A method as recited in claim 1 wherein:

said determining step is performed using a mathematical model of the web and the charging device to determine the output voltage of the charging device.

3. A method as recited in claim 1 wherein:

said determining step is performed using a lookup table stored in the programmable controller.

4. A method as recited in claim 1 wherein:

said determining step is performed with the programmable controller using the algorithm $$V_{electrode}=a_0+a_1U(C/A)+a_2V_{in}+a_3V_{web}+a_4U(C/A)V_{in}+a_5U(C/A)V_{web}+a_6V_{in}V_{web}+a_7[U(C/A)]^2+a_8V_{in}^2+a_9V_{web}^2$$

wherein $V_{web}=(V_{in}-V_{cut})e^{-t/\tau}+V_{cut}$, $V_{web}$ being the voltage created on the web substrate surface, $V_{in}$ being the charge on the web prior to being electrified, $V_{cut}$ being the cutoff voltage of the charging means, and wherein t=l/U, t being the ratio of the width l of the charging means in the lengthwise direction of the web to the web speed U, and wherein $\tau=(Z^*A)(C/A)$, $\tau$ being a time constant which is the product of the impedance-area $Z^*A$ of the charging means times the capacitance per unit area (C/A) of the web, and wherein $(C/A)=\epsilon/d$, $\epsilon$ being the permittivity and d being the thickness of the web substrate, and wherein $a_0$, $a_1$, $a_2$, $a_3$, $a_4$, $a_5$, $a_6$, $a_7$, $a_8$, and $a_9$ are empirical proportionality constants.

5. A method as recited in claim 1 wherein coating the liquid composition onto the surface of the web is performed with a coating apparatus, the method further comprising the steps of:

(a) inducing a subatmospheric pressure below a coating lip of the coating apparatus; and (b) temporarily reducing the subatmospheric pressure beginning at the start of a coating operation.

6. A method as recited in claim 1 wherein:

said depositing step occurs on a portion of the web that includes the splice.

7. A method as recited in claim 1 wherein:

said depositing step occurs on a portion of the web that includes the splice.

8. A method for charging a length of moving web to a voltage level to provide a coating assist with a charging device prior to coating a liquid composition onto a surface of the web with a curtain coating apparatus, an extrusion coating apparatus, or a bead coating apparatus, the method comprising the steps of:

(a) calculating a web capacitance per unit area;

(b) determining an output voltage for the charging device based at least in part on the web capacitance per unit area to achieve a desired web voltage;

(c) detecting an event in the moving web requiring electrostatic charge deposition, the event being a start-up or a splice;

(d) controlling a power supply to deliver the output voltage to the charging device; and (e) depositing an electrostatic charge onto the moving web with the charging device operating at the output voltage for a predetermined time period or for a predetermined length of the web to achieve the desired web voltage ($V_{web}$) after detecting the event requiring electrostatic charge deposition, and stopping the depositing of the electrostatic charge after the predetermined time period or the predetermined length of the web required by the event.

9. An apparatus for coating a web comprising:

(a) a charging device including an electrode adapted to charge a length of moving web, (b) means for detecting an event requiring electrostatic charge deposition onto the moving web to produce a signal, the event being a start-up or a splice;

(c) a programmable controller responsive to the signal, said programmable controller including means for determining an output voltage for the charging device based on at least one of the parameters of web speed (U), web permittivity ($\epsilon$), web thickness (d), and web incoming voltage ($V_{in}$) to achieve a desired web voltage, said programmable controller controlling a power supply connected to the charging device to apply the output voltage to the electrode to achieve the desired web voltage ($V_{web}$) for a predetermined time period or for a predetermined length of the web after detecting the event requiring electrostatic charge deposition, and to stop the depositing of electrostatic charge after the predetermined time period or the predetermined length of the web required by the event; and (d) a coating device for applying the liquid composition to the charged surface of the web, the coating device being a curtain coating apparatus, an extrusion coating apparatus, or a bead coating apparatus.

10. An apparatus as recited in claim 9 wherein:

the means for determining is a mathematical model of the web and the charging device to determine the output voltage of the charging device.

11. An apparatus as recited in claim 9 wherein:

the means for determining is a lookup table stored in the programmable controller.

12. An apparatus as recited in claim 9 wherein:

the means for determining is stored in memory of the programmable controller and is the algorithm $$V_{electrode}=a_0+a_1U(C/A)+a_2V_{in}+a_3V_{web}+a_4U(C/A)V_{in}+a_5U(C/A)V_{web}+a_6V_{in}V_{web}+a_7[U(C/A)]^2+a_8V_{in}^2+a_9V_{web}^2$$

wherein $V_{web}=(V_{in}-V_{cut})e^{-t/\tau}+V_{cut}$, $V_{web}$ being the voltage created on the web substrate surface, $V_{in}$ being the charge on the web prior to being electrified, $V_{cut}$ being the cutoff voltage of the charging means, and wherein $t=l/U$, t being the ratio of the width l of the charging means in the lengthwise direction of the web to the web speed U, and wherein $\tau=(Z^*A)(C/A)$, $\tau$ being a time constant which is the product of the impedance-area $Z^*A$ of the charging means times the capacitance per unit area (C/A) of the web, and wherein $(C/A)=\epsilon/d$, $\epsilon$ being the permittivity and d being the thickness of the web substrate, and wherein $a_0$, $a_1$, $a_2$, $a_3$, $a_4$, $a_5$, $a_6$, $a_7$, $a_8$, and $a_9$ are empirical proportionality constants.

* * * * *